US007254932B2

(12) United States Patent
Tanaka et al.

(10) Patent No.: US 7,254,932 B2
(45) Date of Patent: Aug. 14, 2007

(54) MULTI-PURPOSE AIR-PACKING METHOD AND SYSTEM

(75) Inventors: Yasuzumi Tanaka, Kawasaki (JP); Katsutoshi Yoshifusa, Lake Forest, CA (US)

(73) Assignee: Air-Paq, Inc., Las Vegas, NV (US)

( * ) Notice: Subject to any disclaimer, the term of this patent is extended or adjusted under 35 U.S.C. 154(b) by 0 days.

(21) Appl. No.: 10/991,538

(22) Filed: Nov. 18, 2004

(65) Prior Publication Data

US 2006/0101789 A1 May 18, 2006

(51) Int. Cl.
*B65B 23/00* (2006.01)

(52) U.S. Cl. ..... 53/472; 53/403; 53/139.5

(58) Field of Classification Search ..... 53/472, 53/403, 139.5, 139.6, 139.7; 206/522, 521, 206/591; 383/3
See application file for complete search history.

(56) References Cited

U.S. PATENT DOCUMENTS 3,398,501 A * 8/1968 Aninger ..... 53/472
4,136,141 A * 1/1979 Bauer et al. ..... 53/472
4,235,065 A * 11/1980 Freeman ..... 53/472
4,551,379 A * 11/1985 Kerr ..... 206/522
4,640,080 A * 2/1987 Wright ..... 53/472
4,793,123 A * 12/1988 Pharo ..... 53/472
5,042,663 A * 8/1991 Heinrich ..... 206/522
5,254,074 A * 10/1993 Landers et al. ..... 53/472
5,564,570 A * 10/1996 Jaszai ..... 206/522
5,762,198 A * 6/1998 Hung ..... 206/522
5,769,232 A * 6/1998 Cash et al. ..... 206/522
5,826,723 A 10/1998 Jaszai
5,857,571 A 1/1999 Tschantz et al.
5,901,850 A 5/1999 Jones et al.
5,996,798 A 12/1999 Gessert
6,076,677 A 6/2000 Pozzo
6,464,079 B1 10/2002 Newman
6,513,974 B2 * 2/2003 Malone et al. ..... 206/522
6,629,777 B2 10/2003 Tanaka et al.
6,722,502 B1 4/2004 Newman

* cited by examiner

*Primary Examiner*—Louis Huynh
(74) *Attorney, Agent, or Firm*—Muramatsu & Associates

(57) ABSTRACT

A multi-purpose air-packing method and system enables to pack a product having an irregular shape easily at low cost. The air-packing method includes the steps of placing a product to be protected in a container box; applying a first air-packing device having a plurality of air containers to side surfaces of the product in a manner to surround the product in the container box where each of the air containers has a check valve to maintain compressed air therein independently from one another; and inflating the air-packing device by supplying compressed air to securely hold the product within the container box. Two or more consecutive air containers at one end of the first air-packing device have a cross sectional size smaller than that of other air containers.

6 Claims, 8 Drawing Sheets

MULTI-PURPOSE AIR-PACKING METHOD AND SYSTEM

FIELD OF THE INVENTION

This invention relates to an air-packing system to pack a product of various shapes, and more particularly, to an air-packing method and system utilizing an air-packing device having-a plurality of air containers to pack a product of various shapes and sizes in a container box to securely protect the product from shocks and vibrations.

BACKGROUND OF THE INVENTION

A Styrofoam packing material has been used for a long time for packing commodity and industrial products. Although the Styrofoam package material has a merit such as a good thermal insulation performance, it has also various disadvantages, i.e., recycling the Styrofoam is not possible, soot is produced when it burns, a flake or chip comes off when it is snagged because of it's brittleness, an expensive mold is needed for its production, and a relatively large warehouse is necessary to store it.

Therefore, to solve such problems above, other packing materials and methods have been proposed. One method is a fluid container (air-packing device) for sealingly containing a liquid or gas, typically an air as a cushion. An air-packing device has excellent characteristics to solve the problems in the Styrofoam. First, because the air-packing device is made of only thin films, it does not need a large warehouse to store it unless the air-packing device is inflated. Second, a mold is not necessary for its production because of its simple shape and structure. Third, the air-packing device will not produce a chip or dust which has adverse effect on precision products. Further, recyclable materials can be used for thermoplastic films of the air-packing device. Furthermore, the air-packing device can be produced with low cost.

FIG. 1 shows an example of air-packing device in the conventional technology. The air-packing device 10*a* is composed of first and second air-packing thermoplastic films 13 and 14, respectively, and a check valve 11. Typically, each thermoplastic film is composed of three layers of materials: polyethylene, nylon and polyethylene which are bonded together with appropriate adhesive. The nylon layer is incorporated to increase physical strength of the thermoplastic film. The first and second thermoplastic films are heat-sealed together around seal portions 12*a*, 12*b* after the check valve is attached. Thus, one container bag 10*a* sealed with the heat seal portions 12*a*, 12*b* is formed as shown in FIG. 1.

Air-packing devices are becoming more widespread because of the above noted advantages. Products to be enclosed by air-packing devices come in various shapes, sizes and materials. Moreover, a product having a simple shape can have a complicated shape when combined with other products. Generally, it is difficult and time consuming to pack a product that has irregular shapes or sizes in a container box. Two or more different types of air-packing devices of complicated structure may be necessary to firmly hold a product having a complicated shape. Moreover, it is not cost effective to manufacture specific air-packing devices tailored to fit to each unique product. Thus, there is a need for a cost effective air-packing system that can be applied to various products.

SUMMARY OF THE INVENTION

It is, therefore, an object of the present invention to provide a multi-purpose air-packing method and system to enclose a product that comes with various shapes and sizes within a container box with use of an air-packing device of simple structure.

It is another object of the present invention to provide a method and system to pack a product by an air-packing device as an inflatable cushion for protecting the product from damages due to shocks and vibrations where the air-packing device is configured by a plurality of air containers each having a check valve.

It is a further object of the present invention to provide an air-packing method and system to securely enclose a product of complicated shape in a container box in which an air inlet port of an air-packing device is projected from the container box thereby enabling to supply the compressed air after closing the container box.

It is a further object of the present invention to provide a method and system to enclose a product of complicated shape in a container box to prevent damages to the product due to shocks and vibrations by using an air-packing device having a plurality of air containers of different cross sectional sizes.

One aspect of the present invention is a method of packing a product to prevent damages to the product due to shocks and vibrations. The method includes the steps of: placing a product to be protected in a container box; applying a first air-packing device having a plurality of air containers to side surfaces of the product in a manner to surround the product in the container box; and inflating the air-packing device by supplying compressed air to securely hold the product within the container box.

The method of packing a product further includes the step of laying out a second air-packing device on a bottom surface of the container box as a bottom air cushion before placing the product in the container box. The method further includes the step of laying out a third air-packing device on a top of the product in the container box as a top air cushion after applying the first air-packing device to the sides of the product.

In the air-packing method, preferably, an air inlet port of the air-packing device is exposed through an opening of the container box to outside of the container box, thereby enabling to supply the compressed air to the air-packing device after closing the container box.

In the present invention, the plurality of air containers of the first air-packing device have an identical cross sectional size with one another. Alternatively, the plurality of air containers of the first air-packing device have different cross sectional sizes from one another. The air containers of the air-packing device with small cross sectional size are arranged at one end of the air-packing device. The air containers of the first air-packing device with small cross sectional size and large cross sectional size are arranged in a predetermined order so that the air containers of the air-packing device fit with a product of particular outer shape.

Another aspect of the present invention is an air-packing system for packing a product to prevent damages to the package due to shocks and vibrations. The air-packing system is comprised of a container box for placing a product to be protected therein; a first air-packing device having a plurality of air containers and is applied to side surfaces of the product in a manner to surround the product in the container box; wherein the first air-packing device is inflated by supplying compressed air to securely hold the product within the container box.

According to the multi-purpose air-packing method and system of present invention, a product that comes with various shapes and sizes can be securely packed within a container box with use of an air-packing device of simple structure. The air-packing device as an inflatable cushion is able to protect the product from damages due to shocks and vibrations where the air-packing device has a plurality of air containers each having a check valve. The air-packing method and system of the present invention can enclose a product of complicated shape in a container box by using an air-packing device having a plurality of air containers of different cross sectional sizes.

BRIEF DESCRIPTION OF THE DRAWINGS

FIG. 2A is a plan view thereof and FIG. 2B is a perspective view thereof.

DETAILED DESCRIPTION OF THE INVENTION

The present invention provides an air-packing method and system that can securely hold a product or a set of products of various sizes and shapes in a container box. The present invention utilizes one or more air-packing devices having a plurality of air containers to pack a product in a container box to absorb shocks and vibrations that encounter during the shipment of the products. Generally, the container box used in air-packing system is a carton box, but other type of boxes such as a wood box or plastic box can be used as well.

Figure 2A:
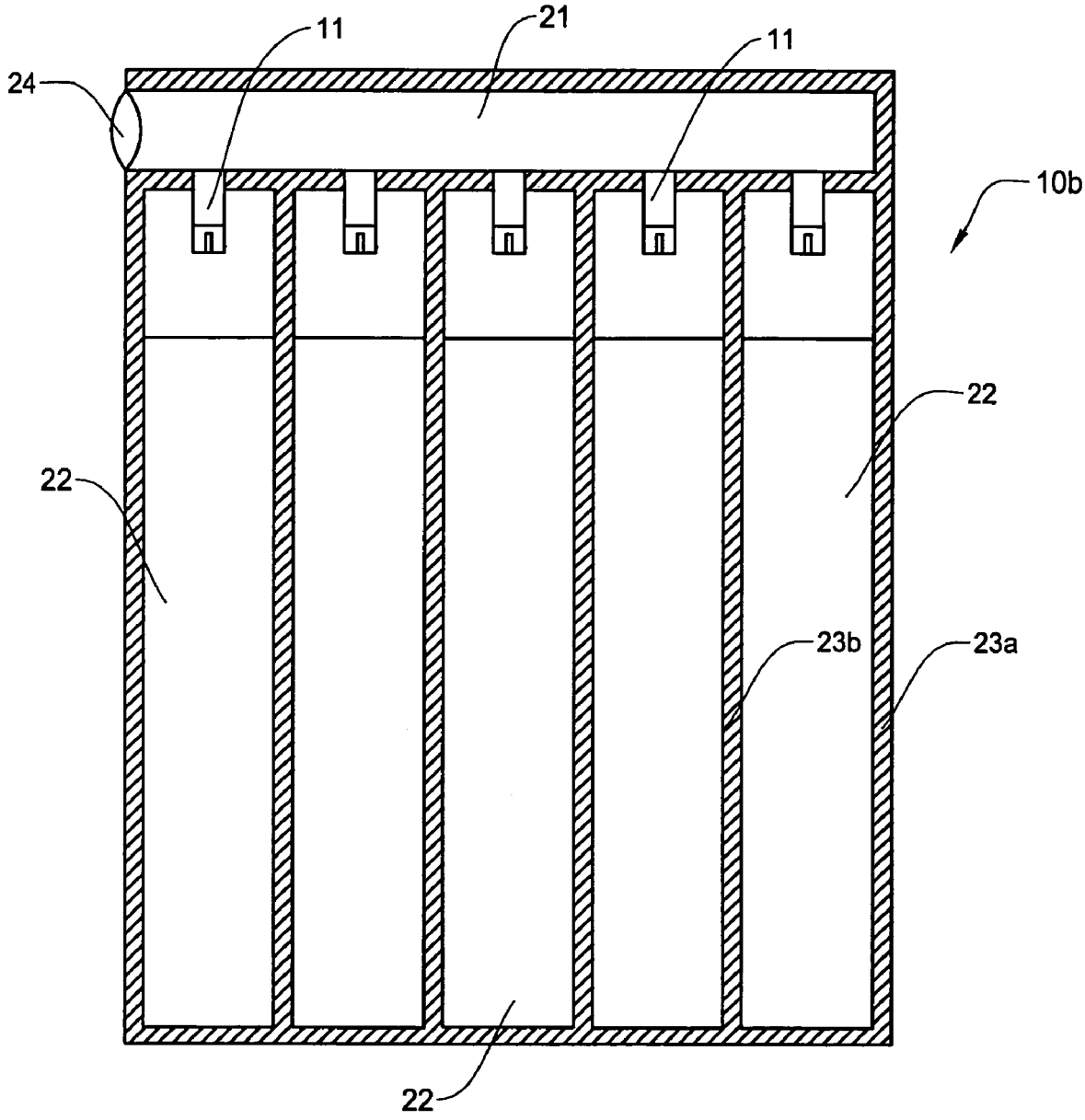
FIGS. 2A and 2B are schematic diagrams showing an example of structure of an air-packing device having a plurality of air containers each having a check valve, where
Figure 2B:
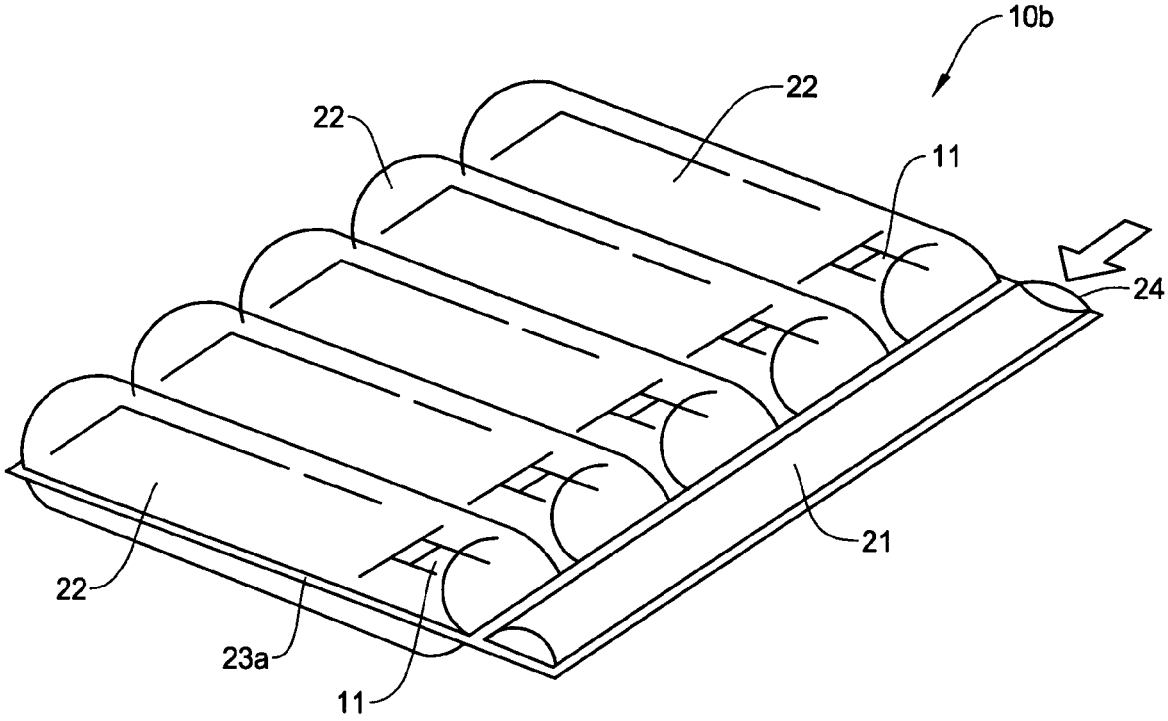

FIGS. 2A and 2B show an example of an air-packing device 10*b* with a plurality of air containers where each air container is provided with a check valve. A main purpose of having a plurality of air containers with corresponding check valves is to increase reliability. Namely, even if one of the air containers suffers from an air leakage for some reason, the air-packing device can still function as a cushion of a product in the distribution channel because other air containers can remain inflated. The structure having a plurality of air containers allows the air-packing device to be bent at the boundary of the air containers to create a desirable shape.

The air-packing device 10*b* is made of first and second thermoplastic films which are bonded together around a rectangular periphery 23*a* and further bonded together at each boundary 23*b* of two adjacent air containers 22 so that a guide passage 21 and a plurality of air containers 22 are created. When the first and second thermoplastic container films are bonded together at the hatched areas 23*a* and 23*b* shown in FIG. 2A, the check valves 11 are also attached to each input of the air container 22. By attaching the check valves 11, each air container 22 becomes independent from the other. An inlet port 24 of the air-packing device 10*b* is used when filling an air or other types of fluid to each air container 22 by using, for example, an air compressor.

FIG. 2B is a perspective view showing the air-packing device 10*b* having the multiple air containers 22 when it is filled with the compressed air. Each air container 22 is filled with the air from the inlet port 24 through the guide passage 21 and the check valve 11. To avoid a rupture of the air container by variations in the environmental temperature, the supply of compressed air to the air container is typically stopped when the air container member 22 is inflated at about 90% of its full expansion rate. After filling the air, the expansion of each air container 22 is maintained because each check-valve 11 prevents the reverse flow of the air. Typically, the air compressor has a gage to monitor the supplied air pressure, and automatically stops supplying the air to the air-packing device 10*b* when the pressure reaches a predetermined value.

The check valve 11 is typically made of one or two thermoplastic valve films to form a fluid pass (not shown). The fluid pass has a tip opening and a valve body to allow a fluid flowing through the fluid pipe from the tip opening but the valve body prevents the reverse flow of the air. Typically the check valve 11 is prepared before manufacturing the air-packing device and attached to the thermoplastic film during the procedure of bonding the thermoplastic films.

The structure and procedure of enclosing a product or a set of products by the air-packing system of the present invention is described in detail with reference to partially cut-out perspective views of FIGS. 3-7. In the drawings, the front side of a container box (ex. carton box) 50 is cut out for an illustration purpose to show the inside of the container box 50. In the example of FIGS. 3-7, two or more air-packing devices each having a plurality of air containers of the same size and shape are used in the container box 50.

Figure 1:
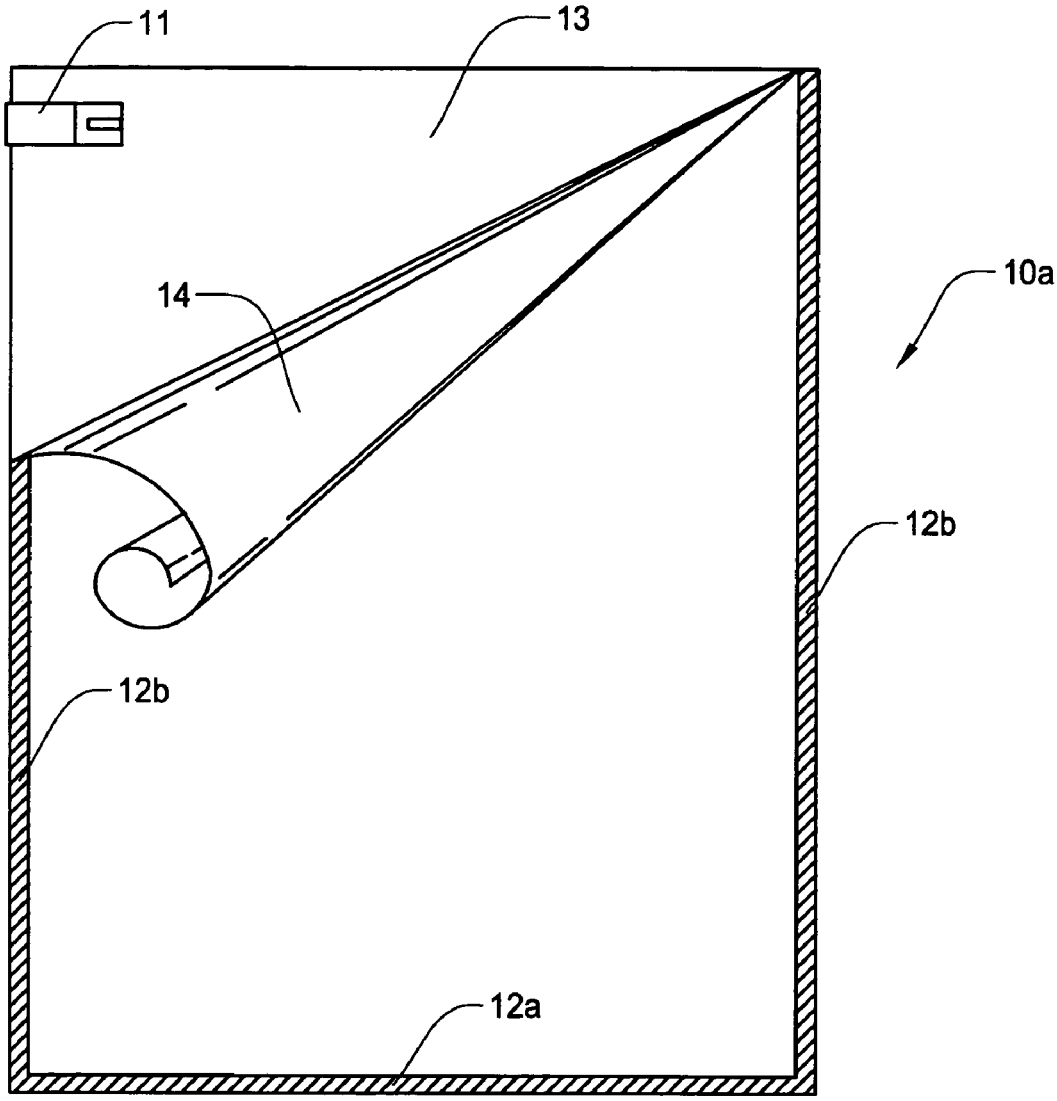
FIG. 1 is a schematic diagram showing an example of outer structure of a typical air-packing device in the conventional technology.
Figure 3:
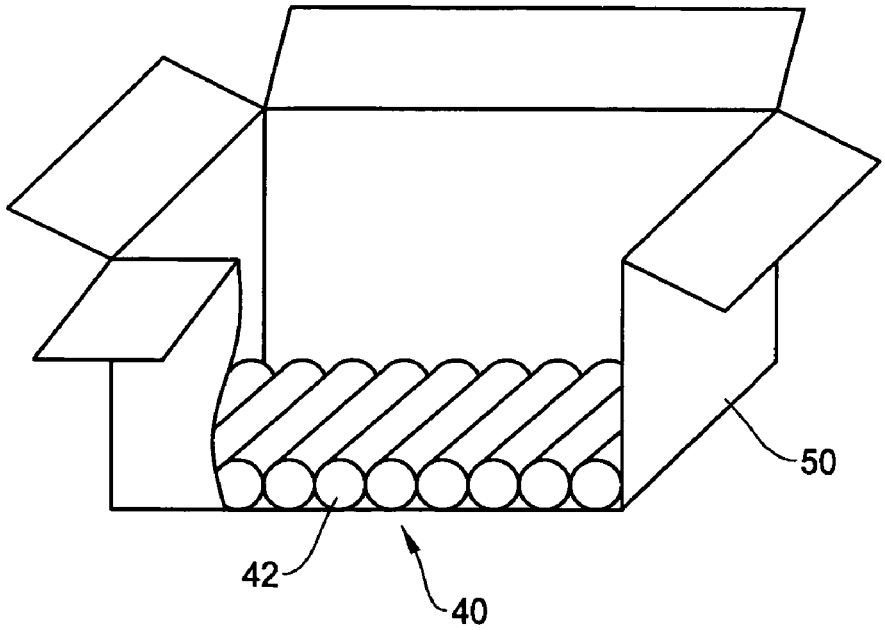
FIG. 3 is a partially cut-out perspective view showing the air-packing system of the present invention where an air-packing device as a bottom air cushion is laid out in a container box.

FIG. 3 shows the air-packing system of the present invention where a bottom air-packing device 40 as a bottom air cushion is laid out in the container box 50. The bottom air-packing device 40 shown in FIG. 3 is comprised of a plurality of air containers 42 such as shown in FIG. 2A and 2B. It is also feasible to use a conventional fluid container made of only one air container body that hold the compressed air as shown in FIG. 1. In FIG. 3, an air inlet port and check valves of the air-packing device 40 are omitted for simplicity of illustration.

Figure 4:
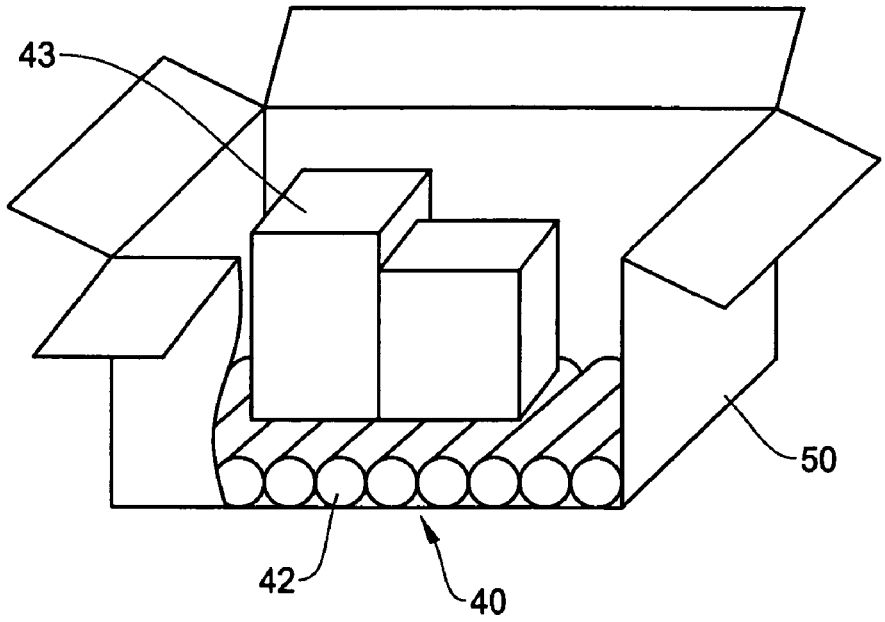
FIG. 4 is a partially cut-out perspective view showing the air-packing system of the present invention where a set of products is placed on the bottom air-packing device in the container box.

When the bottom air-packing device 40 is laid on the bottom surface of the container box 50, a product 43 to be packed in the container box 50 is placed on the air-packing device 40 as shown in FIG. 4. The product 43 can be a single product or a set of two or more products (in this example, two packages of products). Rather than a simple box shape, the product 43 in this example has a relatively complicated outer shape.

Figure 5:
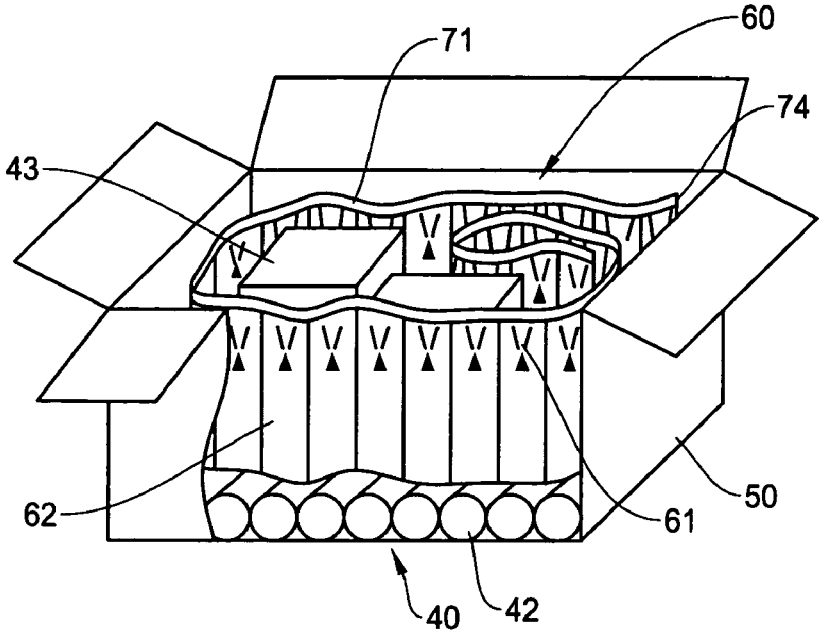
FIG. 5 is a partially cut-out perspective view showing the air-packing system of the present invention where another air-packing device is arranged to encircle the set of products in the container box.
Figure 6A:
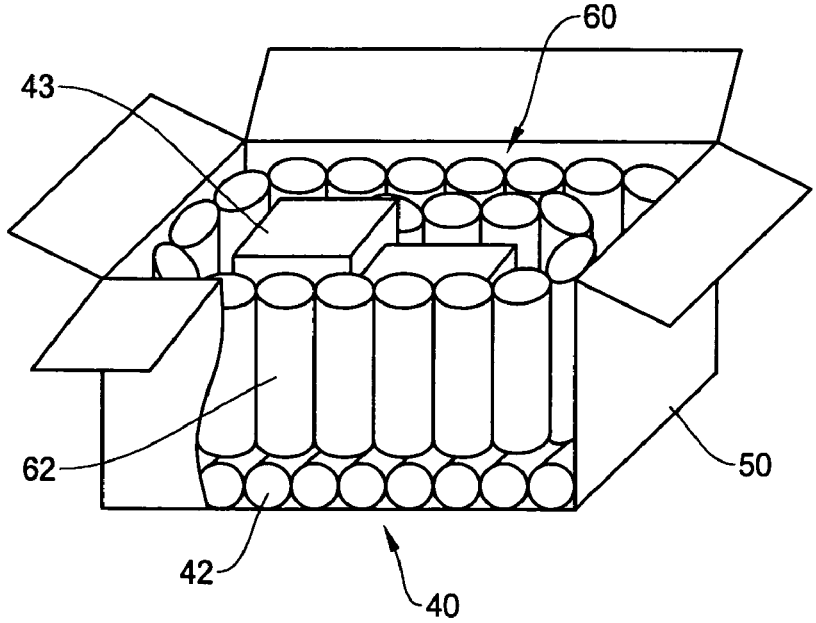
FIG. 6A is a partially cut-out perspective view showing the air-packing system of the present invention of FIG. 5 where the another air-packing device encircling the set of products is inflated to pack the product.
Figure 6B:
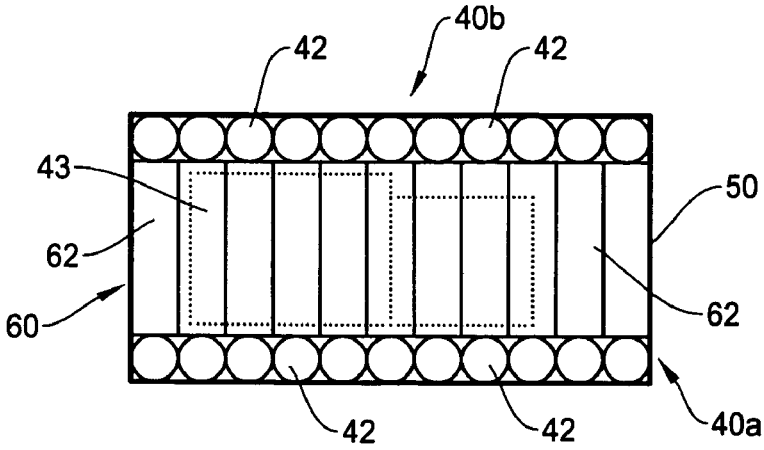
FIG. 6B is a cross sectional front view of the air-packing system of the present invention including top and bottom air-packing devices and the encircling air-packing device.

FIG. 5 shows the condition where another air-packing device 60 having a plurality of air containers is placed in the container box 50 in a manner to surround the sides of the product 43. In this example, the air-packing device 60 is not inflated at this stage, however, it is also possible that the air-packing device 60 is inflated by the compressed air before being placed in the container box 50. The air-packing device 60 is composed of an air passage 71, an air inlet port 74, and a plurality of air containers 62 each of which has a check valve 61. Preferably, a further air-packing device which is similar to the air-packing device 40 is placed at the top of the product 43 and air-packing device 60 (FIG. 6B). Alternatively, the top portion of the air-packing device 60 will be inwardly bent to cover the top area of the product 43.

After the air-packing device 60 is placed inside of the container box 50 in FIG. 5, the air-packing device 60 is filled with the compressed air through the inlet port 74 by means of, for example, an air compressor (not shown). FIG. 6A shows the condition where the air-packing device 60 is inflated so that the product 43 is securely held by the air-packing device 60 which is supported by the container box 50. As noted above, preferably, a further air-packing device 40 which is the same or similar to the air-packing device 40 is placed at the top of the product 43 as a top air cushion. Thus, as shown in a cross sectional front view of FIG. 6B, the air-packing system is configured by a first air packing device 60 that surrounds the sides of the product 43, a second (bottom) air-packing device 40*a* on the bottom surface of the container box 50, and a third (top) air-packing device 40*b* on the upper surface of the product 43.

Figure 7:
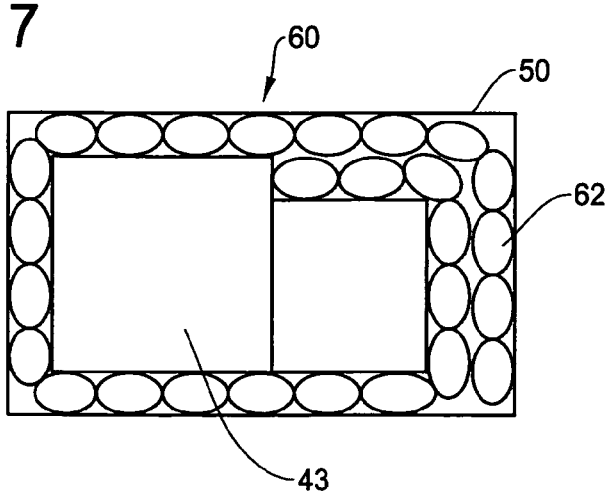
FIG. 7 is a plan view showing the air-packing system of the present invention corresponding to FIG. 6A without the top air-packing device where the air-packing device surrounding the set of products is inflated.

FIG. 7 is a plan view showing the relationship between the product 43, the inflated air-packing device 60, and the container box 50 as described above with reference to FIGS. 3-6. The air-packing devices 40*a* and 40*b* (FIG. 6B) at the top and bottom of the product 43 are not shown for simplicity of illustration. In this manner, the product 43 is tightly packed by the air-packing devices 40*a*, 40*b* and 60 within the container box 50.

It should be noted that although the container box (carton box) 50 has a conventional box shape, the method described above may be applied to any shape of a container box as well. Although the air-packing device 60 is placed at the sides of the product 43 to surround the product 43 in the example described above, such an encircling air-packing device may be placed to surround the top and bottom of the product 43. In such a situation, the air-packing devices 40*a* and 40*b* at the top and bottom of the container box 50 may be positioned at the sides of the product 43.

Figure 8A:
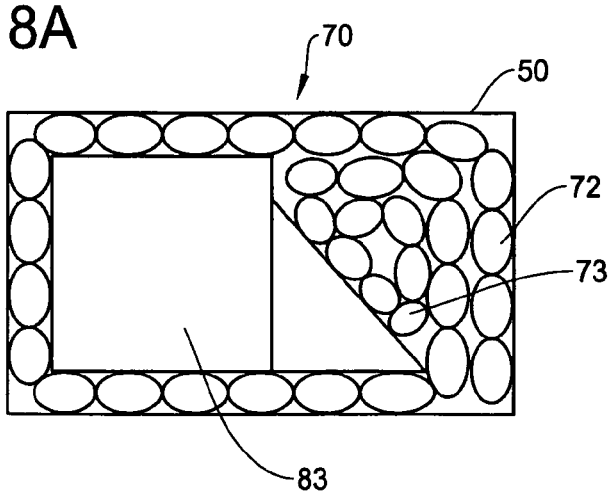
FIG. 8A is a plan view showing another example of the air-packing system of the present invention where the air-packing device surrounding the products and having air containers of different sizes is inflated.
Figure 8B:
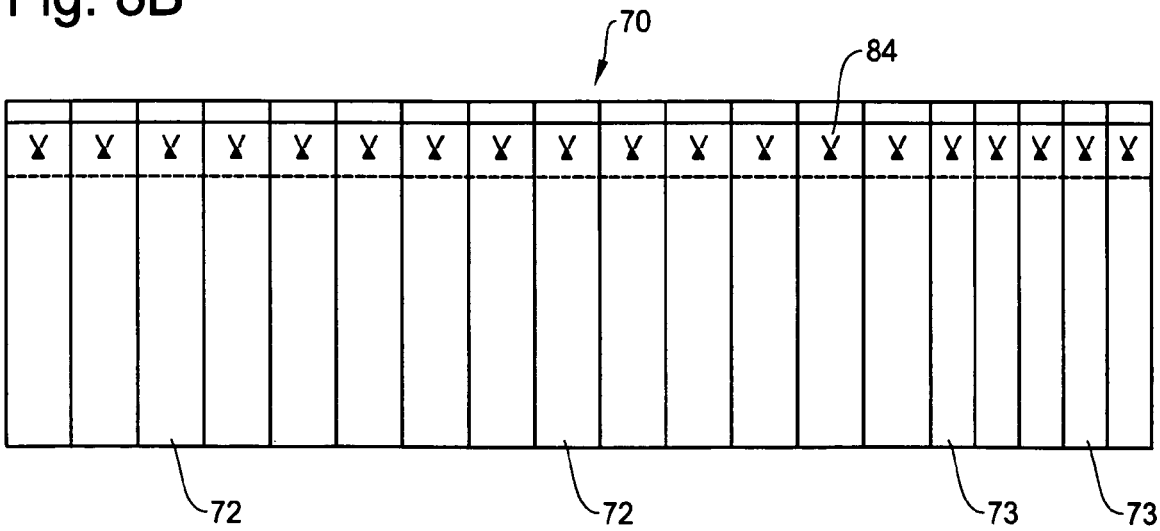
FIG. 8B is a front view of the air-packing device of FIG. 8A when it is flatly extended.

FIG. 8A is a top view of the container box in another embodiment of the present invention where a product 83 having a shape different from that of the product 43 in FIGS. 3-7 is packed by an air-packing device 70 within the container box 50. FIG. 8B is a front view of the air-packing device 70 when it is flatly extended before placing in the container box 50 of FIG. 8A. The air-packing device 70 in this example has a plurality of air containers 72 and 73 where the air containers 73 have a cross sectional size smaller than that of the air containers 72. FIG. 8B also shows check valves 84 provided to the air containers 72 and 73.

The air containers 73 with smaller size will be configured, for example, at one end of the air-packing device 70 to contact with the surfaces of the product 83 at an area having a relatively complicated shape. The air container 73 with smaller cross sectional size can be more flexible to fit with the irregular outer shape of the product 83. Thus, even though the product 83 has the irregular shape, the air-packing device 70 can securely hold the product 83 within the container box 50 when it is inflated.

Figure 9:
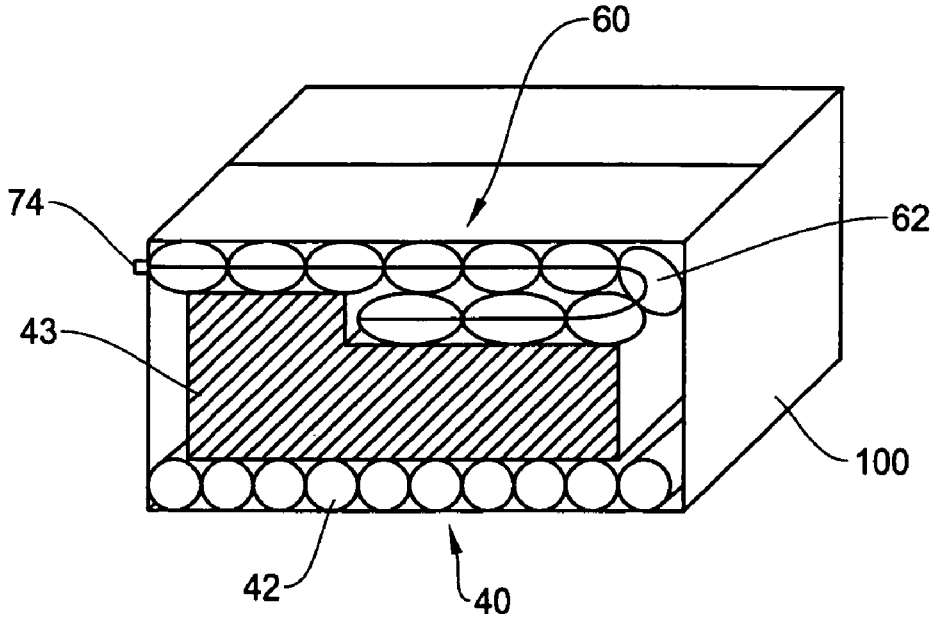
FIG. 9 is a perspective view showing a further example of the air-packing system of the present invention where an air inlet port of the air-packing device is projected from the container box.
Figure 10:
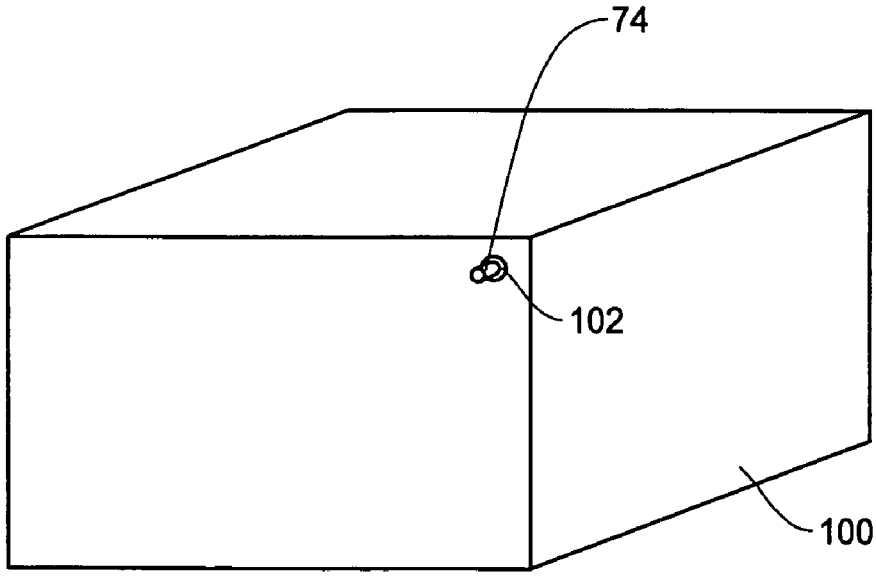
FIG. 10 is a perspective view of the air-packing system of FIG. 9 having the air inlet port on the container box viewed in an angle different from that of FIG. 9.

A further embodiment of the present invention is described with reference FIGS. 9 and 10. FIG. 9 is a perspective view showing the air-packing system of the present invention where an air inlet port of the air-packing device is projected from the container box. FIG. 10 is a perspective view of the air-packing system 9 having the air inlet port on the container box viewed in an angle different from that of FIG. 9. In FIG. 9, unlike an actual embodiment, the front side of the container box 50 is illustrated in a transparent manner to show the configuration of a container box 100 and an air-packing device 60 in the container box 100.

In FIG. 9, the product 43 to be protected is placed on the bottom air cushion made of the air-packing device 40 which is laid out at bottom of the container box 100. The air inlet port 74 of the air-packing device 60 is projected from the container box 100 through an opening 102 (FIG. 10) formed on the wall of the box 100. This configuration allows the compressed air to be supplied to the air-packing device 60 after the container box 100 is closed.

Figure 11A:
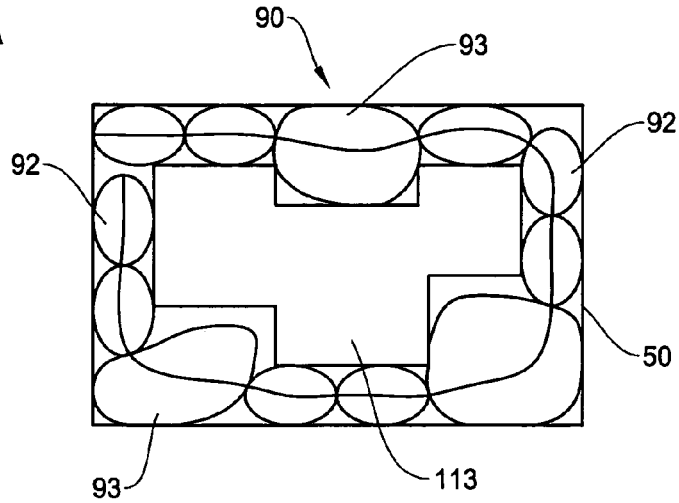
FIG. 11A is a plan view showing an example of an air-packing system specifically made for packing a particular product having a complicated outer shape.
Figure 11B:
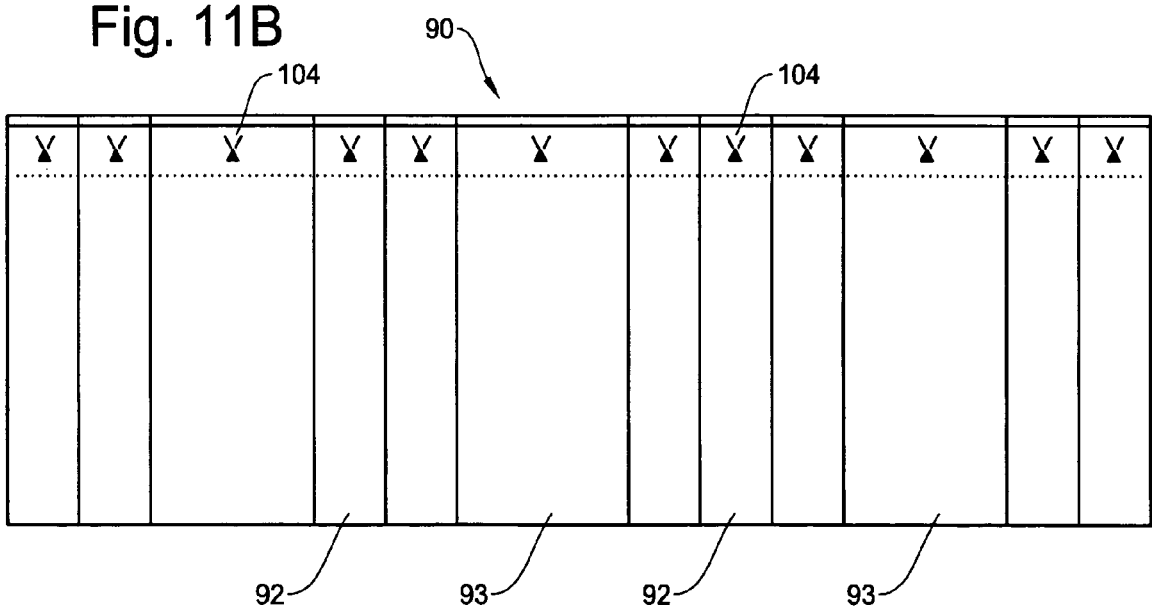
FIG. 11B is a front view of the air-packing device used in the air-packing system of FIG. 11A.

In the case where a large number of products having the same shape and size are to be distributed, air-packing devices specifically made for such products can be used for packing the products. Such an example is shown in FIGS. 11A and 11B where an air-packing device 90 is configured by air containers of different sizes that are aligned in the order specific to the particular shape of a product 113. FIG. 11A is a plan view showing the air-packing system specifically made for packing the particular product 113 having a complicated shape, and FIG. 11B is a front view of the air-packing device 90 of FIG. 11A when it is flatly extended.

More specifically, the air-packing device 90 includes air containers 92 and 93 where a cross sectional size of the air container 93 is larger than that of the air container 92. The air containers 92 and the air containers 93 are arranged in a specific order to match the outer shape of the product 113 to be protected. The front view of the air-packing device 90 in FIG. 11B also shows such an order of the air containers 92 and 93. The example of FIG. 11B also shows the check valves 104 for the corresponding air containers 92 and 93. As shown in FIG. 11A, the air containers 93 fit with the relatively large indented portions of the product 113 to fill-in the spaces between the container box 50 while the air containers 92 are positioned at relatively narrow areas in the container box 50.

According to the multi-purpose air-packing method and system of present invention, a product that comes with various shapes and sizes can be securely packed within a container box with use of an air-packing device of simple structure. The air-packing device as an inflatable cushion is able to protect the product from damages due to shocks and vibrations where the air-packing device has a plurality of air containers each having a check valve. The air-packing method and system of the present invention can enclose a product of complicated shape in a container box by using an air-packing device having a plurality of air containers of different cross sectional sizes.

Although the invention is described herein with reference to the preferred embodiments, one skilled in the art will readily appreciate that various modifications and variations may be made without departing from the spirit and the scope of the present invention. Such modifications and variations are considered to be within the purview and scope of the appended claims and their equivalents.

What is claimed is:

1. A method of packing a product to prevent damages to the product due to shocks and vibrations, comprising the following steps of:

placing a product to be protected in a container box;

applying a first un-inflated air-packing device having a plurality of connected air containers to side surfaces of the product in a manner to surround the product in the container box; each of the air containers having a uniform cross section and a check valve to maintain compressed air therein independently from one another;

laying out a second inflated air packing device having a plurality of connected air containers on a bottom surface of the container box as a bottom air cushion before placing the product in the container box; and inflating the first air-packing device by supplying an compressed air to securely hold the product within the container box;

wherein two or more air containers in series at one end of the first air-packing device have a cross sectional size smaller than that of other air containers.

2. A method of packing a product as defined in claim 1, further comprising the step of:

laying out a third air-packing device having a plurality of connected air containers on a top of the product in the container box as a top air cushion after applying the first air-packing device to the sides of the product, and inflating the third air-packing device.

3. A method of packing a product as defined in claim 1, wherein said step of inflating the first air-packing device includes a step of exposing an air inlet port of the first air packing device through an opening of the container box to outside of the container box, thereby enabling to supply the compressed air to the first air-packing device after closing the container box.

4. A method of packing a product as defined in claim 1, wherein said plurality of air containers of said second air-packing device have an identical cross sectional size to one another.

5. A method of packing a product as defined in claim 2, wherein said plurality of air containers of said third air-packing device have an identical cross sectional size to one another.

6. A method of packing a product as defined in claim 1, wherein said two or more air containers of the first air-packing device with small cross sectional size and an air container with large cross sectional size are arranged in a predetermined order so that the air containers of the air-packing device fit with a product of particular outer shape.

* * * * *